US007676176B2

(12) United States Patent
Fujiwara et al.

(10) Patent No.: US 7,676,176 B2
(45) Date of Patent: Mar. 9, 2010

(54) IMAGE FORMING APPARATUS INCLUDING COVER AND SUPPORTING UNIT

(75) Inventors: Hiroshi Fujiwara, Osaka (JP); Masafumi Takahira, Ibaraki (JP); Yasuhide Ohkubo, Osaka (JP); Ippei Kimura, Osaka (JP); Tomofumi Inoue, Osaka (JP); Takeru Muramatsu, Ibaraki (JP)

(73) Assignee: Ricoh Company, Limited, Ohta-ku, Tokyo (JP)

( * ) Notice: Subject to any disclaimer, the term of this patent is extended or adjusted under 35 U.S.C. 154(b) by 0 days.

(21) Appl. No.: 12/213,324

(22) Filed: Jun. 18, 2008

(65) Prior Publication Data

US 2009/0022514 A1 Jan. 22, 2009

(30) Foreign Application Priority Data

Jul. 17, 2007 (JP) ..... 2007-186015

(51) Int. Cl.
*G03G 15/08* (2006.01)

(52) U.S. Cl. ..... 399/121; 399/124; 399/125

(58) Field of Classification Search ..... 399/121, 399/124, 299, 302, 303, 313
See application file for complete search history.

(56) References Cited

U.S. PATENT DOCUMENTS

| | | | | |
|---|---|---|---|---|
| 5,219,154 | A | 6/1993 | Fukube et al. | |
| 5,316,282 | A | 5/1994 | Fukube et al. | |
| 5,322,269 | A | 6/1994 | Fukube et al. | |
| 5,405,128 | A | 4/1995 | Fujiwara et al. | |
| 2006/0290049 | A1 | 12/2006 | Fujiwara | |
| 2007/0065201 | A1 | 3/2007 | Fujiwara et al. | |
| 2007/0110458 | A1 | 5/2007 | Inoue et al. | |
| 2007/0147859 | A1 | 6/2007 | Adachi et al. | |
| 2007/0183816 | A1 | 8/2007 | Hatayama et al. | |
| 2007/0212108 | A1 * | 9/2007 | Hozono et al. | 399/121 |
| 2007/0269233 | A1 | 11/2007 | Sakashita et al. | |
| 2007/0285701 | A1 | 12/2007 | Ohta et al. | |
| 2008/0003022 | A1 | 1/2008 | Sakashita et al. | |
| 2008/0006166 | A1 * | 1/2008 | Ohkubo et al. | 101/479 |

FOREIGN PATENT DOCUMENTS

| | | |
|---|---|---|
| JP | 2002-296927 | 10/2002 |
| JP | 2005-031309 | 2/2005 |

* cited by examiner

*Primary Examiner*—David M Gray
*Assistant Examiner*—Barnabas T Fekete
(74) *Attorney, Agent, or Firm*—Harness, Dickey & Pierce

(57) ABSTRACT

An image forming apparatus includes a cover and a supporting unit. The supporting unit includes a holding member, a supporting member, a first biasing unit, and a positioning unit. The holding member holds the transferring member. The supporting member movably supports the holding member, so that the transferring member can move toward or away from a specific member arranged in the main body. The first biasing unit biases the transferring member toward the specific member. When the cover is in a closed state, the transferring member is pressed against the specific member. The positioning unit performs positioning of the supporting member with respect to the main body.

14 Claims, 3 Drawing Sheets

IMAGE FORMING APPARATUS INCLUDING COVER AND SUPPORTING UNIT

CROSS-REFERENCE TO RELATED APPLICATIONS

The present application claims priority to and incorporates by reference the entire contents of Japanese priority document 2007-186015 filed in Japan on Jul. 17, 2007.

BACKGROUND OF THE INVENTION

1. Field of the Invention

The present invention relates to an image forming apparatus.

2. Description of the Related Art

Typically, a direct transfer method or an indirect transfer method is employed in color image forming apparatuses for transferring images to a recording medium. In the direct transfer method, toner images of different colors are formed on a plurality of photosensitive elements, and those toner images are then directly transferred onto a recording medium (hereinafter, "sheet") in a superimposed manner thereby forming a color image on the recording medium. On the other hand, in the indirect transfer method, a toner image of a specific color is formed on each of a plurality of photosensitive elements, those toner images are first transferred onto an intermediate transfer belt in a superimposed manner thereby forming a color image on the intermediate transfer belt, and then, the color image is transferred from the intermediate transfer belt onto a sheet.

Generally, image forming apparatuses employing the indirect transfer method include, apart from the intermediate transfer belt, a secondary transfer roller, and an opposing roller. The secondary transfer roller and the opposing roller are arranged parallel to each other in an abutting manner with the intermediate transfer belt interposed therebetween. The intermediate transfer belt and the secondary transfer roller are pressed against each other, and a sheet is passed through a nip, i.e., a transfer nip, between the intermediate transfer belt and the secondary transfer roller. Because of this arrangement, toner images on the intermediate transfer belt are transferred onto the sheet as the sheet passes through the transfer nip.

Japanese Patent Application Laid-open No. 2002-296927 discloses a conventional image forming apparatus in which a secondary transfer roller is integrally attached to an openable and closable cover (movable case), and an intermediate transfer belt is arranged in a main body of the image forming apparatus. With this configuration, it is easier to perform maintenance work, or remove jammed sheets. When the cover is opened, the secondary transfer roller separates from the intermediate transfer belt, so that it is possible to quickly and easily remove sheets jammed in the transfer nip. Furthermore, when the cover is opened, the intermediate transfer belt is exposed to the outside, so that repair or replacement of the intermediate transfer belt can be performed quickly and easily. When the cover is in a closed state, the secondary transfer roller is biased toward the intermediate transfer belt by a spring arranged on the cover, so that the secondary transfer roller and the intermediate transfer belt are pressed against each other.

In the conventional image forming apparatus, however, the spring for biasing the secondary transfer roller is attached to the cover. Therefore, a pressure applied from the secondary transfer roller to the intermediate transfer belt changes if the cover is not in a desired closed position. If the pressure applied from the secondary transfer roller to the intermediate transfer belt is nonuniform, sheets may not enter in the transfer nip in a desired manner, or images may not be transferred onto sheets in a desired manner.

SUMMARY OF THE INVENTION

It is an object of the present invention to at least partially solve the problems in the conventional technology.

According to an aspect of the present invention, an image forming apparatus includes a main body that houses a specific member; a cover that is pivotably attached to the main body whereby the cover can be opened and closed with respect to the main body, the cover having an inner surface that faces toward the main body; a supporting unit that is arranged on the inner surface of the cover and supports a transferring member, the supporting unit including a holding member that holds the transferring member; a supporting member that is arranged on the inner surface of the cover and movably supports the holding member so that the transferring member can move toward or away from the specific member; and a first biasing unit that biases the holding member toward the specific member, wherein when the cover is in a closed state the first biasing unit biases the holding member such that the transferring member is pressed against the specific member to form a nip therebetween, so that a toner image is transferred onto a recording medium; and a positioning unit that performs positioning of the supporting member with respect to the main body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
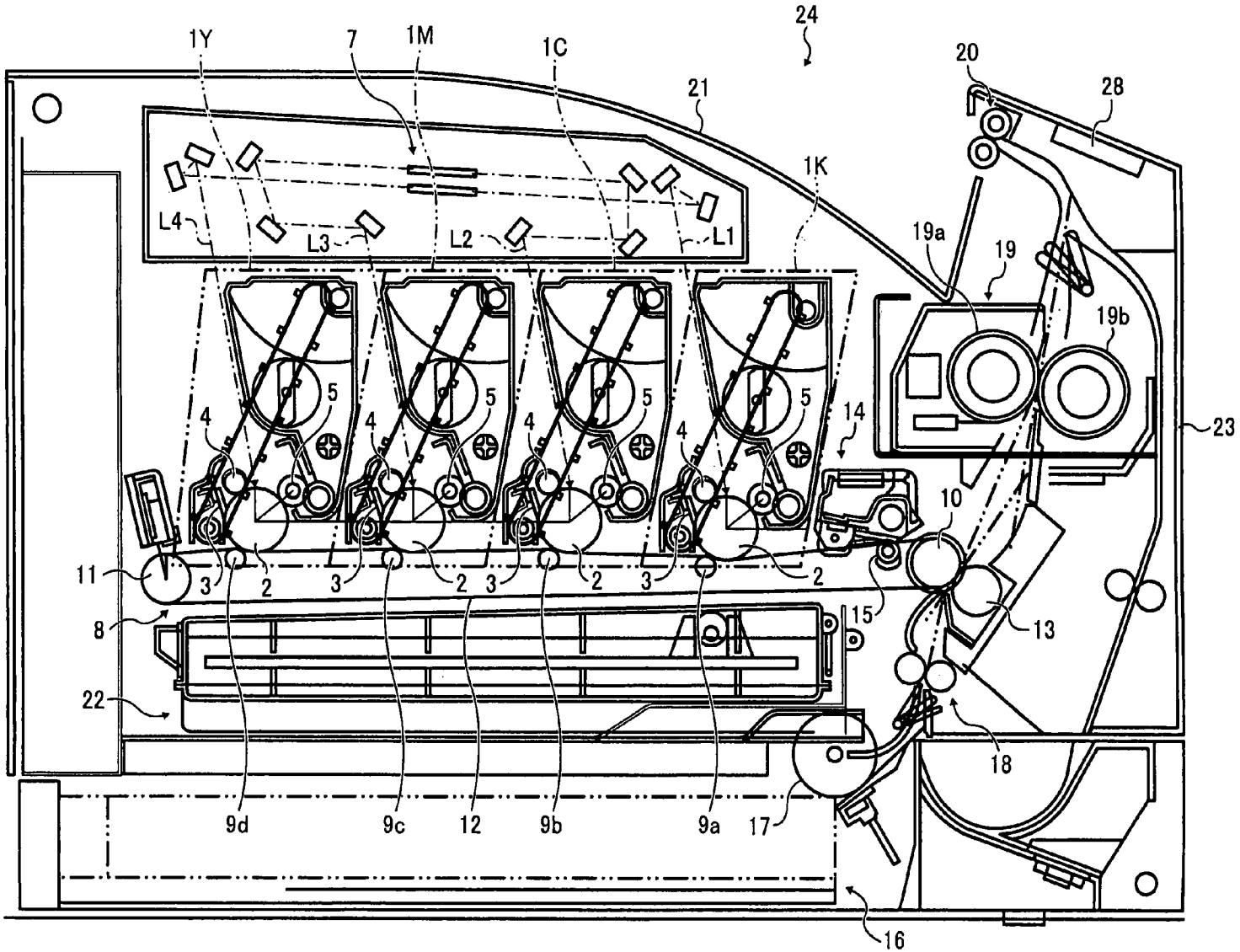
FIG. 1 is a schematic diagram of an image forming apparatus according to an embodiment of the present invention.

FIG. 1 is a schematic diagram of an image forming apparatus according to an embodiment of the present invention. The image forming apparatus includes four process units 1K, 1C, 1M, and 1Y. The process units 1K, 1C, 1M, and 1Y form a color image by using toners of four primary colors, i.e., black, cyan, magenta, and yellow.

The process units 1K, 1C, 1M, and 1Y have the same configuration except that they contain toner of different colors. The configuration and operation of the process unit 1K will be described in detail as an example. The process unit 1K includes an image carrier 2, a cleaning unit 3, a charging unit 4, and a developing unit 5. The process unit 1K is detachably attached to a main body of the image forming apparatus.

An exposure device 7 is arranged above the process units 1K, 1C, 1M, and 1Y. The exposure device 7 outputs four laser beams L1 to L4 corresponding to the four process units 1K, 1C, 1M, and 1Y based on image data.

A transfer belt device 8 is arranged under the process units 1K, 1C, 1M, and 1Y. The transfer belt device 8 includes an endless intermediate transfer belt 12. The intermediate transfer belt 12 is supported and rotated by four primary transfer rollers 9*a*, 9*b*, 9*c*, 9*d*; a drive roller 10; a supporting roller 11; or the like. The primary transfer rollers 9*a*, 9*b*, 9*c*, 9*d* are arranged parallel to and in an abutting manner with respect to the respective image carriers 2 of the process units 1K, 1C, 1M, 1Y. A secondary transfer roller 13 is arranged parallel to the drive roller 10 in an abutting manner. The secondary transfer roller 13 is pressed against the intermediate transfer belt 12 to form a transfer nip therebetween. An endless transfer conveying belt can be used instead of the secondary transfer roller 13. A belt cleaning device 14 is arranged above the intermediate transfer belt 12 to clean the toner remaining on the intermediate transfer belt 12 after the transfer operation. A cleaning backup roller 15 is arranged parallel to the belt cleaning device 14 in an abutting manner.

A feeding cassette 16 and a feeding roller 17 are arranged at the bottom of the image forming apparatus. The feeding cassette 16 can contain one or more sheets as recording media. The feeding roller 17 feeds one sheet at a time from the feeding cassette 16. A pair of registration rollers 18 is arranged between the feeding roller 17 and a transfer nip formed between the secondary transfer roller 13 and the intermediate transfer belt 12. The registration rollers 18 temporarily stop a sheet fed to them by the feeding roller 17.

A fixing device 19 is arranged above the secondary transfer roller 13. The fixing device 19 includes a heating roller 19*a* and a pressure roller 19*b*. The heating roller 19*a* includes a heat source (not shown), such as a halogen lamp. The pressure roller 19*b* is in pressure contact with the heating roller 19*a*.

A pair of discharging rollers 20 is arranged above the fixing device 19. The discharging rollers 20 discharge a sheet with an image printed thereon out of the image forming apparatus. Discharged sheets are stacked on a catch tray 21. The catch tray 21 is formed, for example, by curving a part of an upper cover of the image forming apparatus in an inward direction. An operation panel 28 is arranged on the front side (the right side in FIG. 1) of the upper portion of the image forming apparatus. The operation panel 28 is used by a user to give instructions for controlling operations of the image forming apparatus.

A waste-toner container 22 is arranged between the transfer belt device 8 and the feeding cassette 16. A waste-toner conveying hose (not shown) extends from the belt cleaning device 14 to an inlet of the waste-toner container 22. Thus, waste toner collected by the belt cleaning device 14 is conveyed to and accumulated in the waste-toner container 22.

When the feeding roller 17 rotates based on a feeding signal from a control unit (not shown) included in the image forming apparatus, the feeding roller 17 feeds one blank sheet from the feeding cassette 16 to a nip between the registration rollers 18. When a leading end of the sheet reaches the nip between the registration rollers 18, the registration rollers 18 temporarily stop the sheet to synchronize the timing of conveying the sheet with the timing of transferring the toner image on the intermediate transfer belt 12.

The structure and operation of the process unit 1K will be described below as an example; because, the other process units 1C, 1M, 1Y have similar structure and perform similar operation. The charging unit 4 uniformly charges the surface of the image carrier 2 to a high electric potential. The exposure device 7 causes the laser beam L1 to be emitted to a portion on the surface of the image carrier 2 based on image data. An electric potential of the portion then decreases whereby an electrostatic latent image is formed on the portion. The developing unit 5 applies black toner onto the electrostatic latent image thereby forming (developing) a black toner image. The toner image formed on the image carrier 2 is then primary-transferred to the intermediate transfer belt 12. Each of the other process units 1C, 1M, 1Y performs the same processes as described above to form a respective toner image in cyan, magenta, and yellow on the respective image carrier 2. Those toner images of four colors are then transferred onto the intermediate transfer belt 12 in a superimposed manner thereby forming a color toner image on the intermediate transfer belt 12.

The cleaning unit 3 of each of the process units 1K, 1C, 1M, 1Y removes toner remaining on the surface of the respective image carrier 2 after the process of transferring the toner image to the intermediate transfer belt 12 is finished. After the cleaning unit 3 cleans the image carrier 2, a charge removing device (not shown) removes residual charge from the image carrier 2.

Then, the registration rollers 18, which are temporarily holding a sheet, start to rotate again thereby feeding the sheet to the transfer nip between the intermediate transfer belt 12 and the secondary transfer roller 13 in such a manner that the timing of conveying the sheet in the transfer nip is in synchronization with the timing of transferring the toner images on the intermediate transfer belt 12. The secondary transfer roller 13 then secondary-transfers the toner images from the intermediate transfer belt 12 to the sheet.

The sheet with the color toner image is conveyed to the fixing device 19. The sheet is then sandwiched and pressed between the heating roller 19*a* and the pressure roller 19*b*, so that the unfixed color toner image is fixed to the sheet with heat and pressure. The sheet with the fixed color toner image is then conveyed to the discharging rollers 20. The discharging rollers 20 then discharge the sheet to the catch tray 21.

After the toner image is transferred from the intermediate transfer belt 12 to the sheet, some toner remains on the intermediate transfer belt 12. The belt cleaning device 14 removes the toner remaining on the intermediate transfer belt 12. The toner removed from the intermediate transfer belt 12 is conveyed by a waste-toner conveying unit (not shown), and collected in the waste-toner container 22.

Figure 2:
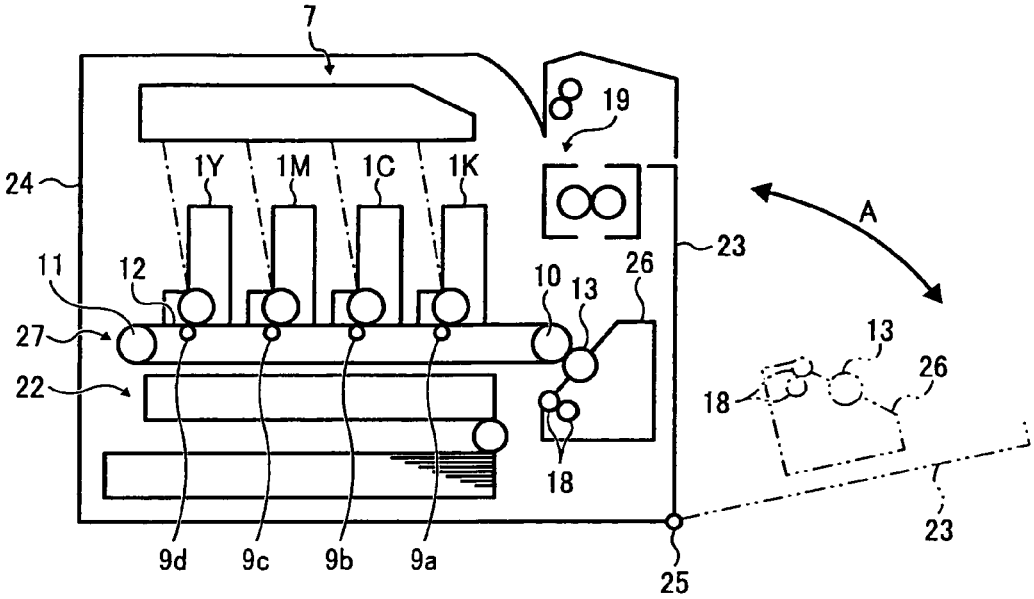
FIG. 2 is a schematic diagram for explaining operation of opening/closing a front cover of the image forming apparatus.

The image forming apparatus has a front cover 23 arranged on the front side (the right side in FIG. 1) of a main body 24. The front cover 23 can be opened and closed. FIG. 2 is a schematic diagram for explaining operation of opening/closing the front cover 23. The front cover 23 can swing in directions indicated by a two-headed arrow A around a fulcrum 25 that is positioned at the bottom of the front cover 23. A supporting unit 26 is mounted on an inner surface of the front cover 23. The supporting unit 26 supports the secondary transfer roller 13 and the registration rollers 18. When the front cover 23 is opened by swinging in a forward direction (to the right side in FIG. 2), the secondary transfer roller 13, the registration rollers 18, and the like, move apart from the intermediate transfer belt 12 and the waste-toner container 22. When a sheet jams in the nip between the secondary transfer roller 13 and the intermediate transfer belt 12, the front cover 23 is opened so that the secondary transfer roller 13 separates from the intermediate transfer belt 12, and the jammed sheet is taken out. In this manner, the jammed sheet can be quickly removed from between the secondary transfer roller 13 and the intermediate transfer belt 12.

Figure 3:
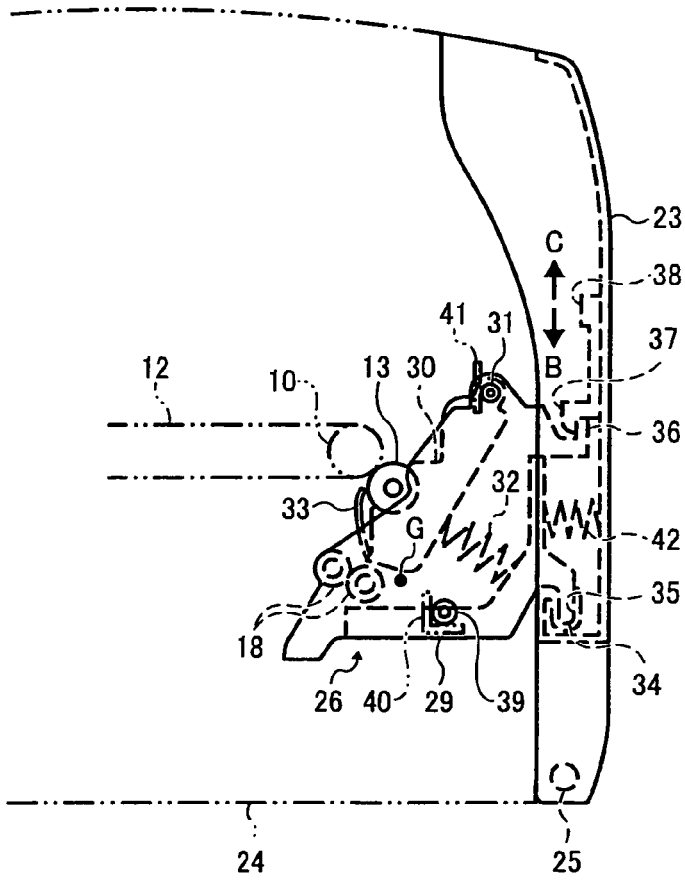
FIG. 3 is a schematic diagram of a relevant part of the image forming apparatus.

FIG. 3 is a schematic diagram of a relevant part of the image forming apparatus. The supporting unit 26 includes a supporting member 29 and a holding member 30. The supporting member 29 is detachably attached to the inner surface of the front cover 23. The holding member 30 is mounted on the supporting member 29. The registration rollers 18 are rotatably mounted on the supporting member 29. The secondary transfer roller 13 is rotatably mounted on the holding member 30. A guide member 33 is also mounted on the holding member 30. The guide member 33 guides a sheet from the registration rollers 18 to the transfer nip.

Figure 4:
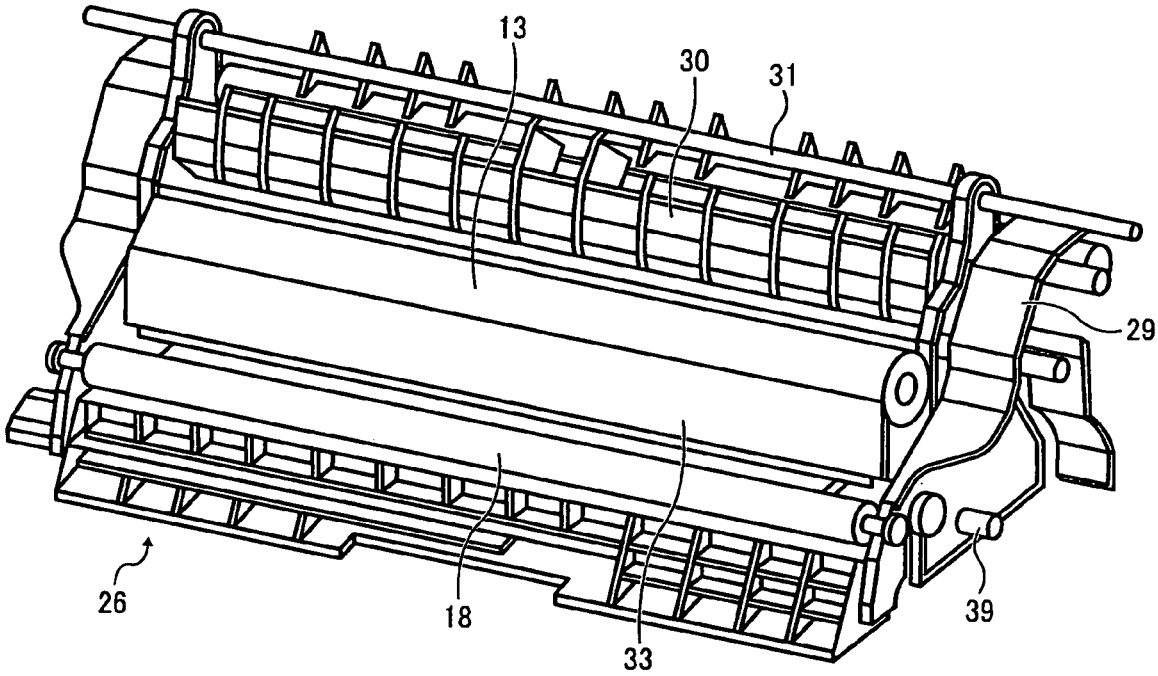
FIG. 4 is a perspective view of a supporting unit of the image forming apparatus.

FIG. 4 is a perspective view of the supporting unit 26. The supporting member 29 and the holding member 30 are, for example, made of a resin. The supporting member 29 and the holding member 30 extend in directions of rotation axes of the registration rollers 18 and the secondary transfer roller 13.

A supporting shaft 31 is arranged on an upper portion of the supporting member 29 in the longitudinal direction. An upper edge of the holding member 30 is rotatably attached to the supporting shaft 31, so that the holding member 30 can swing around the supporting shaft 31. Two first biasing units 32, such as coil springs, are arranged between the holding member 30 and the supporting member 29. The holding member 30 is biased by the first biasing units 32 in such a direction that the holding member 30 is moved apart from the supporting member 29. The first biasing units 32 could be symmetrically arranged with a space therebetween in the longitudinal direction of the holding member 30 or the supporting member 29, or the first biasing units 32 could be arranged in a different manner.

The supporting member 29 is detachably attached to the front cover 23. Specifically, the supporting member 29 includes a protruding portion 34 and an engaged portion 36 by which the supporting member 29 is attached to the front cover 23. A concave portion 35 and a locking claw 37 are arranged on the front cover 23. The protruding portion 34 is inserted into the concave portion 35. The locking claw 37 is configured to engage with the engaged portion 36. The locking claw 37 can slide in directions indicated by an arrow B and an arrow C shown in FIG. 3. The locking claw 37 is biased by a spring (not shown) in the direction indicated by the arrow B to engage with the engaged portion 36. A disengagement operating portion 38 is integrally formed on the locking claw 37. The disengagement operating portion 38 moves the locking claw 37 in the direction indicated by the arrow C, so that the locking claw 37 disengages from the engaged portion 36.

An intermediate transfer unit 27 (FIG. 2) including the primary transfer rollers 9*a*, 9*b*, 9*c*, 9*d*, the drive roller 10, the supporting roller 11, and the intermediate transfer belt 12, and the waste-toner container 22 can be pulled out in the forward direction (the right side in FIG. 2) from an opening that is formed in the image forming apparatus when the front cover 23 is in an open state. Thus, the intermediate transfer unit 27 and the waste-toner container 22 are detached from the image forming apparatus. With this configuration, it is easier to perform maintenance works on the intermediate transfer unit 27 and the waste-toner container 22. However, when detaching the intermediate transfer unit 27 and the waste-toner container 22 from the main body 24, the supporting unit 26, which is attached on the front cover 23, disturbs the detachment works.

Therefore, when the intermediate transfer unit 27, and the like, is to be pulled out from the main body 24 of the image forming apparatus, the supporting unit 26 is detached from the front cover 23.

Figure 5:
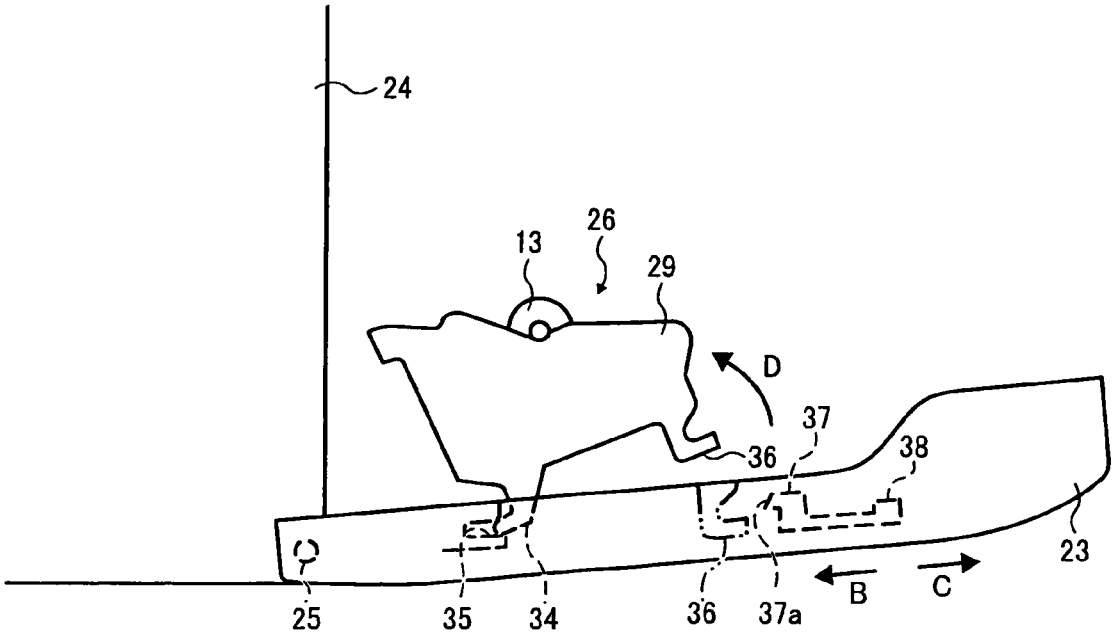
FIG. 5 is a schematic diagram for explaining operation of attaching/detaching the supporting unit from the front cover.

FIG. 5 is a schematic diagram for explaining operation of attaching/detaching the supporting unit 26 from the front cover 23. When opening the front cover 23, the disengagement operating portion 38 is operated to move the locking claw 37 in the direction indicated by the arrow C against a biasing force of the spring. As a result, the engagement between the locking claw 37 and the engaged portion 36 is released. The supporting member 29 is then moved in a direction indicated by an arrow D, and the protruding portion 34 is pulled out from the concave portion 35. In this manner, the supporting member 29 (the supporting unit 26) is detached from the front cover 23.

To attach the supporting unit 26 to the front cover 23, first, the protruding portion 34 is inserted into the concave portion 35. When the engaged portion 36 is put close to the front cover 23, the engaged portion 36 is in contact with a tapered portion 37*a* of the locking claw 37, because the locking claw 37 is biased in the direction indicated by the arrow B due to the biasing force of the spring. The engaged portion 36 is pushed against the tapered portion 37*a* whereby the locking claw 37 is moved in the direction indicated by the arrow C against the biasing force of the spring. Immediately after the engaged portion 36 is moved over the locking claw 37 toward the front cover 23, the locking claw 37 is moved back in the direction indicated by the arrow B due to the biasing force of the spring, so that the locking claw 37 engages with the engaged portion 36. In this manner, the attachment of the supporting unit 26 to the front cover 23 is completed.

In the state that the supporting member 29 (the supporting unit 26) is attached to the front cover 23, looseness hardly exists between the protruding portion 34 and the concave portion 35 and between the engaged portion 36 and the locking claw 37 in the width direction of the image forming apparatus (the width direction of a conveyed sheet). Moreover, in the state that the supporting member 29 is attached to the front cover 23, looseness does exist between the protruding portion 34 and the concave portion 35 and between the engaged portion 36 and the locking claw 37 in the left and right directions in FIG. 3 (the forward and backward directions). With this configuration, it is easier to attach/detach the supporting member 29 to/from the front cover 23.

However, if looseness exists in the left and right directions as described above, it is difficult to obtain sufficient positional accuracy of the supporting unit 26. If the positional accuracy of the supporting unit 26 is insufficient, positional accuracy of the secondary transfer roller 13, or the like, is lowered. As a result, a pressure between the secondary transfer roller 13 and the intermediate transfer belt 12 becomes nonuniform. This can cause conveying of the sheet in an undesired manner, degrading the image quality.

The positional accuracy of the supporting unit 26 and the secondary transfer roller 13 can be improved with the configuration explained below.

That is, the image forming apparatus is provided with a positioning unit that performs positioning of the supporting member 29 with respect to the main body 24, even if the looseness exists between the supporting member 29 and the front cover 23. The positioning unit includes an abutting member arranged on the supporting member 29, and a receiving member arranged in the main body 24. The abutting member abuts with the receiving member when the front cover 23 is in a closed state.

As shown in FIG. 3, a protruding member 39 is arranged on a lower portion of a side of the supporting member 29 and it functions as an abutting member of a first positioning unit. An L-shaped plate member 40 is arranged in the main body 24 and it functions as a receiving member of the first positioning unit. The supporting shaft 31 functions as an abutting member of a second positioning unit. An I-shaped plate member 41 is arranged in the main body 24 and it functions as a receiving member of the second positioning unit.

The protruding member 39 is arranged on each of the left and right sides of the supporting member 29. The plate member 40 is also arranged on each of the left and right sides of the supporting member 29. Furthermore, the plate member 41 is arranged on each of the left and right sides of the supporting member 29. The supporting shaft 31 is long and extends parallel to the rotation axis of the secondary transfer roller 13 such that each end of the supporting shaft 31 abuts with a respective one of the plate members 41 when the front cover 23 is in the closed state.

The shapes of the plate members 40 and 41 are not limited to those shown in FIG. 3. For example, the plate member 40 can be formed into a V-shape or a U-shape having an opening toward a direction from which the protruding member 39 approaches. Furthermore, a guide member can be arranged on each of the plate member 40 and the plate member 41 to guide the protruding member 39 and the supporting shaft 31 to the plate member 40 and the plate member 41, respectively.

As shown in FIG. 3, a reference letter G indicates the center of gravity of the supporting unit 26. The protruding member 39 is closer to the front cover 23 than the center of gravity G is.

Two second biasing units 42, such as coil springs, are arranged between the supporting member 29 and the front cover 23. The second biasing units 42 are symmetrically placed in the longitudinal direction with a space therebetween. When the front cover 23 is in the closed state, the second biasing units 42 bias the supporting member 29 toward the main body 24. The protruding member 39 and the supporting shaft 31 are pressed against the plate member 40 and the plate member 41, respectively, by a biasing force of the second biasing units 42.

When the front cover 23 is in the closed state, the biasing force of the first biasing units 32 is applied in such a direction that the protruding member 39 and the supporting shaft 31 are moved apart from the plate member 40 and the plate member 41, respectively. The biasing force of the second biasing units 42 is set to be larger than that of the first biasing units 32, so that it is assured that the protruding member 39 and the supporting shaft 31 abut with the plate member 40 and the plate member 41, respectively.

When closing the front cover 23, the front cover 23 is pushed toward the main body 23. The supporting unit 26, which is attached to the front cover 23, moves toward the main body 24.

When the front cover 23 is in the closed position, as shown in FIG. 3, the protruding member 39 abuts with the plate member 40 and the supporting shaft 31 abuts with the plate member 41. Because the protruding member 39 abuts with the plate member 40, the supporting member 29 is prevented from moving in the upward and downward directions, and in the left and right directions (the forward and backward directions) in FIG. 3.

Because the supporting shaft 31 abuts with the plate member 41, the supporting member 29 is prevented from rotating around the abutment point between the protruding member 39 and the plate member 40. In this manner, the angle of the supporting member 29 is set, and the supporting member 29 is set in a predetermined position. Because the supporting shaft 31 and the protruding member 39 are located apart from each other, i.e., the supporting shaft 31 is located in the upper portion and the protruding member 39 is located in the lower portion of the supporting member 29, the supporting member 29 can be accurately positioned with respect to the main body 23.

Furthermore, after the protruding member 39 and the supporting shaft 31 abut with the plate member 40 and the plate member 41, respectively, the protruding member 39 and the supporting shaft 31 are pressed against the plate member 40 and the plate member 41 by the biasing force of the second biasing units 42. Therefore, the position of the supporting member 29 can be set in a steady manner.

When the front cover 23 is in the closed position, the secondary transfer roller 13 is parallel to and in abutment with the drive roller 10 via the intermediate transfer belt 12. The secondary transfer roller 13 is pressed against the intermediate transfer belt 12 by the first biasing units 32. It should be noted that the second biasing units 42 press the protruding member 39 and the supporting shaft 31 against the plate member 40 and the plate member 41, respectively, to set the supporting member 29 in a predetermined position. Therefore, a pressure applied from the secondary transfer roller 13 to the intermediate transfer belt 12 is not affected by the biasing force of the second biasing units 42.

When the front cover 23 is in the closed position, the front cover 23 engages with the main body 24 by a locking mechanism (not shown), so that the front cover 23 is maintained in the closed state until the locking mechanism is released.

When the front cover 23 is in the closed state, looseness exists between the engaged portion 36 and the locking claw 37. Therefore, the supporting member 29 floats from the front cover 23. Specifically, because the supporting member 29 can be moved toward or away from the front cover 23 to some extent, the position of the supporting member 29 is not fixed with respect to the closed position of the front cover 23. Therefore, even if the front cover 23 is not in a desired position, the supporting member 29 is set in a predetermined position with respect to the main body 24. Because the supporting member 29 is set in the predetermined position with respect to the main body 24, the biasing force applied to the secondary transfer roller 13 by the first biasing units 32 does not change depending on the position of the front cover 23 in the closed state. In this manner, a uniform pressure will be applied between the secondary transfer roller 13 and the intermediate transfer belt 12.

When the front cover 23 is the closed state, the center of gravity G is closer to the main body 24 than the abutment point between the protruding member 39 and the plate member 40 is. Therefore, the protruding member 39 and the supporting shaft 31 are biased by a gravity force acting at the center of gravity G in such a direction to move close to the plate member 40 and the plate member 41. Thus, it is ensured that the protruding member 39 and the supporting shaft 31 abut with the plate member 40 and the plate member 41, respectively.

The gravity force acting at the center of gravity G functions as a biasing unit that biases the protruding member 39 and the supporting shaft 31 toward the plate member 40 and the plate member 41. With the smaller biasing force of the second biasing units 42, a sufficient biasing force can be obtained for pressing the protruding member 39 and the supporting shaft 31 against the plate member 40 and the plate member 41. It is preferable that the biasing force of the second biasing units 42 is small. When the biasing force of the second biasing units 42 is small, a weaker pressing force is applied from the second biasing units 42 to the supporting member 29 or to the surface of the front cover 23, so that there are less chances that the supporting member 29 or the front cover 23 gets deformed due to the pressing force of the second biasing units 42.

It is preferable that a spring constant of coil springs that are used as the first biasing units 32 is low. If the spring constant is high, the biasing force of the first biasing units 32 could change due to a dimensional tolerance or an assembly error of each of the members. On the other hand, if the spring constant is low, the coil springs must be long enough to generate a sufficient biasing force for biasing the holding member 30. Moreover, as shown in FIG. 3, it is preferable that the first biasing units 32 are located as far from the supporting shaft 31 as possible. This is because, if the first biasing units 32 are located farther from the supporting shaft 31, a larger space for arranging the first biasing units 32 can be obtained between the supporting member 29 and the holding member 30.

The present invention is not limited to the above-described embodiments, and various changes can be made within a scope of the present invention. Although it is explained above that the supporting unit 26 is detachably attached to the front cover 23, the supporting unit 26 can be firmly fixed to the front cover 23.

Furthermore, in the above-described embodiment, the present invention is applied to the image forming apparatus employing the indirect transfer method. However, the present invention can be applied to an image forming apparatus employing the direct transfer method.

According to an aspect of the present invention, it is possible to press the transferring member against the specific member arranged in the main body with a uniform pressure. Furthermore, the supporting member can be accurately positioned with respect to the main body of the image forming apparatus. Moreover, the position of the supporting member is not affected by the position of the cover when the cover is in the closed state, so that the supporting member can be positioned appropriately irrespective of the position of the cover.

Furthermore, the abutting member can abut with the receiving member in a steady manner. Moreover, the accuracy of positioning the supporting member with respect to the main body of the image forming apparatus can be improved. Furthermore, the number of components in the image forming apparatus can be reduced, and therefore the costs of the image forming apparatus can be lowered. Moreover, the supporting member can be accurately held in a predetermined angle and position with respect to the main body of the image forming apparatus. Furthermore, it is possible to shorten a moving path along which the abutting member moves when the cover is opened or closed, and therefore it is easy to ensure the moving path inside the image forming apparatus.

Moreover, the abutting member of the first positioning unit can abut with the receiving unit in a steady manner. Furthermore, the present invention can be applied to an image forming apparatus using a transfer roller. Moreover, the recording medium can be conveyed in a desired manner.

Furthermore, registration rollers can be set in a predetermined position with respect to the image forming apparatus. Moreover, the guide member can guide the recording medium to the transferring member in a stable manner. Furthermore, the present invention can be applied to an image forming apparatus that employs the indirect transfer method using the intermediate transfer member. Moreover, it is easier to perform maintenance works on the transferring member. Furthermore, it is possible to prevent the supporting member from interfering with the intermediate transfer member when the intermediate transfer member is detached from the image forming apparatus. Moreover, the recording medium can be conveyed in a desired manner, and images can be transferred onto the recording medium in a desired manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a main body that houses a specific member;

a cover that is pivotably attached to the main body whereby the cover can be opened and closed with respect to the main body, the cover having an inner surface that faces toward the main body;

a supporting unit that is arranged on the inner surface of the cover and supports a transferring member, the supporting unit including a holding member that holds the transferring member;

a supporting member that is arranged on the inner surface of the cover and movably supports the holding member so that the transferring member can move toward or away from the specific member; and a first biasing unit that biases the holding member toward the specific member, wherein when the cover is in a closed state the first biasing unit biases the holding member such that the transferring member is pressed against the specific member to form a nip therebetween, so that a toner image is transferred onto a recording medium;

a positioning unit that performs positioning of the supporting member with respect to the main body; and a second biasing unit that biases the supporting member toward the main body, wherein the positioning unit includes an abutting member that is arranged on the supporting member, and a receiving member that is arranged in the main body, wherein the abutting member abuts the receiving member when the cover is in the closed state, wherein the supporting member is movably attached to the inner surface of the cover, so that the supporting member can move toward or away from the main body, and wherein the first biasing unit biases the abutting member away from the receiving member by a first biasing force, the second biasing unit biases the abutting member toward the receiving member by a second biasing force, and the second biasing force is larger than the first biasing force.

2. The image forming apparatus according to claim 1, wherein the abutting member includes a plurality of abutting members, and the receiving member includes a receiving member corresponding to each of the abutting members.

3. The image forming apparatus according to claim 1, wherein the holding member is configured to swing around a supporting shaft arranged on the supporting member, so that the transferring member can move toward or away from the specific member, and the supporting shaft is the abutting member.

4. The image forming apparatus according to claim 1, wherein the transferring member is a transfer roller, and the holding member rotatably holds the transfer roller.

5. The image forming apparatus according to claim 1, further comprising a conveying unit that is arranged on the supporting member to convey the recording medium.

6. The image forming apparatus according to claim 5, wherein the conveying unit includes a pair of registration rollers.

7. The image forming apparatus according to claim 1, further comprising a guide member that is arranged on the holding member to guide the recording medium to the transferring member.

8. The image forming apparatus according to claim 1, wherein the specific member is an intermediate transfer member onto which a toner image is primary-transferred, and the transferring member is a secondary transfer member that secondary-transfers primary-transferred toner image to the recording medium.

9. The image forming apparatus according to claim 8, wherein the intermediate transfer member is configured to be attached to or detached from the main body through an opening that is formed in the image forming apparatus when the cover is in an opened state.

10. The image forming apparatus according to claim 9, wherein the supporting member is detachably attached to the inner surface of the cover.

11. An image forming apparatus, comprising:

a main body that houses a specific member;

a cover that is pivotably attached to the main body whereby the cover can be opened and closed with respect to the main body, the cover having an inner surface that faces toward the main body;

a supporting unit that is arranged on the inner surface of the cover and supports a transferring member, the supporting unit including a holding member that holds the transferring member;

a supporting member that is arranged on the inner surface of the cover and movably supports the holding member so that the transferring member can move toward or away from the specific member; and a first biasing unit that biases the holding member toward the specific member, wherein when the cover is in a closed state the first biasing unit biases the holding member such that the transferring member is pressed against the specific member to form a nip therebetween, so that a toner image is transferred onto a recording medium; and a positioning unit that performs positioning of the supporting member with respect to the main body, wherein the positioning unit includes an abutting member that is arranged on the supporting member; and a receiving member that is arranged in the main body, wherein the abutting member abuts with the receiving member when the cover is in the closed state, and wherein the cover is arranged on a front side of the main body, and is configured to be opened and closed by swinging in forward and backward directions around a fulcrum that is positioned at a lower end of the cover, and the positioning unit includes a first positioning unit and a second positioning unit, wherein the first positioning unit includes a first abutting member and a first receiving member, and the second positioning unit includes a second abutting member and a second receiving member, wherein the first abutting member and the first receiving member prevent the supporting member from moving in forward and backward directions and in upward and downward directions, and the second abutting member and the second receiving member prevent the supporting member from rotating around an abutment point between the first abutting member and the first receiving member.

12. The image forming apparatus according to claim 11, wherein the first abutting member is arranged on a lower portion of the supporting member.

13. The image forming apparatus according to claim 11, wherein the first abutting member is closer to the cover than a center of gravity of the supporting unit is.

14. The image forming apparatus according to claim 11, wherein the holding member is configured to swing around a supporting shaft arranged on the supporting member, so that the transferring member can move toward or away from the specific member, and the supporting shaft is the second abutting member.

* * * * *